US008721217B2

(12) United States Patent
Bornemann et al.

(10) Patent No.: US 8,721,217 B2
(45) Date of Patent: May 13, 2014

(54) SELF-MOVING GROUND COMPACTOR

(71) Applicant: Hamm AG, Tirschenreuth (DE)

(72) Inventors: Detlef Bornemann, Leonberg (DE); Joachim Bauer, Mahring (DE)

(73) Assignee: Hamm AG, Tirschenreuth (DE)

( * ) Notice: Subject to any disclaimer, the term of this patent is extended or adjusted under 35 U.S.C. 154(b) by 0 days.

(21) Appl. No.: 13/661,178

(22) Filed: Oct. 26, 2012

(65) Prior Publication Data

US 2013/0108367 A1 May 2, 2013

(30) Foreign Application Priority Data

Oct. 26, 2011 (DE) ..... 10 2011 085 240

(51) Int. Cl.

| | |
|---|---|
| ***E01C 19/26*** | (2006.01) |
| ***A01B 33/00*** | (2006.01) |
| ***A01B 15/00*** | (2006.01) |
| ***B21B 45/02*** | (2006.01) |

(52) U.S. Cl.
USPC ..... 404/129; 15/256.51; 172/39; 172/606

(58) Field of Classification Search
USPC ..... 404/103, 129, 121, 124; 15/256.51; 280/855; 172/610, 606, 566, 563, 565, 172/39, 558; 100/174
See application file for complete search history.

(56) References Cited

U.S. PATENT DOCUMENTS

| | | | | |
|---|---|---|---|---|
| 474,038 | A * | 5/1892 | Baugh | 404/129 |
| 776,037 | A | 11/1904 | Townsend | |
| 905,073 | A | 11/1908 | Henn et al. | |
| 918,992 | A | 4/1909 | Gaines | |
| 983,196 | A | 1/1911 | Anderson | |
| 1,194,875 | A * | 8/1916 | Pfeil | 280/855 |
| 1,704,465 | A * | 3/1929 | Donham | 280/855 |
| 1,719,330 | A * | 7/1929 | Johnson | 280/855 |
| 1,840,070 | A * | 1/1932 | Webber | 280/855 |
| 1,933,679 | A * | 11/1933 | Nicewander et al. | 280/855 |
| 1,942,655 | A | 1/1934 | McCormick et al. | |
| 2,082,141 | A * | 6/1937 | Beran | 280/855 |
| 2,937,883 | A * | 5/1960 | Alcoriza | 280/855 |
| 3,085,484 | A * | 4/1963 | McAdams et al. | 404/121 |

(Continued)

FOREIGN PATENT DOCUMENTS

| | | |
|---|---|---|
| JP | 6-8408 U | 2/1994 |
| JP | 6-46010 U | 6/1994 |

(Continued)

OTHER PUBLICATIONS

European Patent Application No. EP 12189755.7, European Search Report mailed Feb. 11, 2013 (6 pages).

(Continued)

*Primary Examiner* — Thomas B Will
*Assistant Examiner* — Abigail A Risic
(74) *Attorney, Agent, or Firm* — Rothwell, Figg, Ernst & Manbeck P.C.

(57) ABSTRACT

A self-moving ground compactor comprises at least one compacting roll and a least one scraper device, allocated to a compacting roll, pivotally supported at a support arrangement and in a pivotal operating position the scraper contacting the allocated roll, an operating lever for the pivotal operation of the scraper, and a latching arrangement for fixating the scraper in at least one pivotal non-operating position not contacting the allocated compacting roll.

9 Claims, 6 Drawing Sheets

(56) References Cited

U.S. PATENT DOCUMENTS

Figure 1:
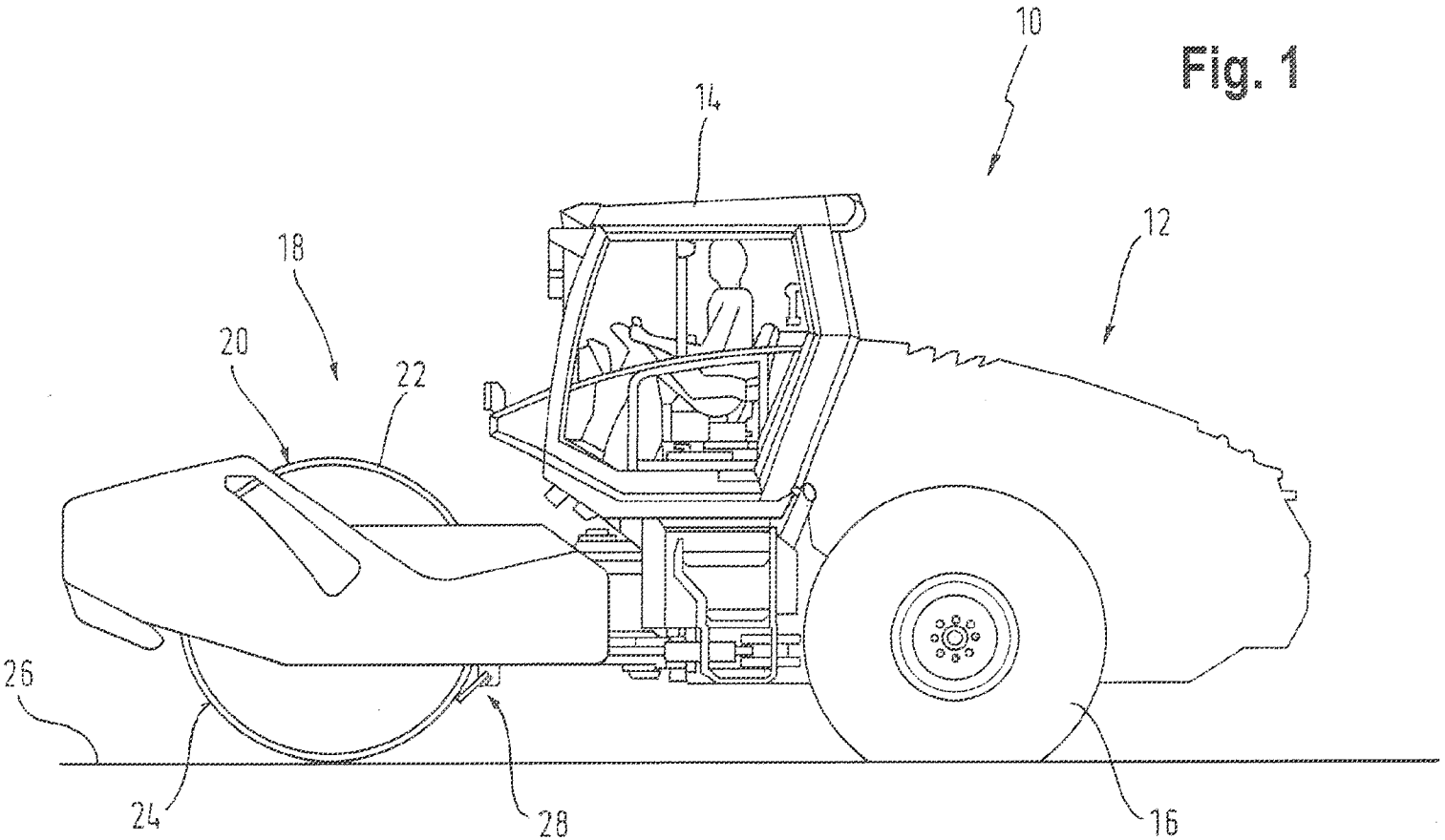

| | | | | |
|---|---|---|---|---|
| 3,802,339 | A * | 4/1974 | Andersson et al. | 100/174 |
| 5,222,828 | A * | 6/1993 | Magalski | 404/103 |
| 5,988,940 | A * | 11/1999 | Johansson | 404/129 |
| 7,044,683 | B2 * | 5/2006 | Berg | 404/129 |

FOREIGN PATENT DOCUMENTS

| | | | |
|---|---|---|---|
| JP | 7-42365 | U | 8/1995 |
| JP | 8-165610 | A | 6/1996 |
| JP | 08165610 | A | 6/1996 |
| JP | 11-222806 | A | 8/1999 |
| JP | 2001-131906 | A | 5/2001 |

OTHER PUBLICATIONS

German Patent Application No. DE 10 2011 085 240.9, Search Report mailed Sep. 12, 2012 (5 pages).

English translation of Japanese Office Action, JP Application No. 2012-213750, Notice of Refusal, Dispatching No. 611639, Dispatching No. 611639. Serial No. F39518A1, 7 pages.

* cited by examiner

SELF-MOVING GROUND COMPACTOR

RELATED APPLICATION

This application claims the benefit of German patent application no. 10 2011 085 240.9, filed in Germany on Oct. 26, 2011, the entire contents of which are incorporated herein by this reference.

The present invention relates to a self-moving ground compactor, which can be used for compacting asphalt, gravel, dirt, or the like. Such ground compactors generally comprise at least one compacting roll, by which it moves over the ground to be compacted and compacting is achieved by stress, on the one hand, and by applying vibrations, on the other hand.

In order to allocate such compacting rolls advantageously at least one scraper device is provided, which during operation contacts the surface of the compacting roll. With such a scraper device it can be achieved, on the one hand, that any liquid, for example water, applied to the surface of the compacting roll is distributed in the direction of the width of the roll surface in order for to generated liquid film on the surface of the roll to prevent or at least aggravate any material to be compacted from adhering. Further, any materials adhering can be released by the scraper device contacting the roll.

The objective of the present invention is to provide a self-moving ground compactor in which a scraper device can be released from contacting the allocated compacting roll in a simple fashion.

According to the invention this objective is attained in a self-moving ground compactor comprising at least one compacting roll and allocated to at least one compactor roll at least one scraper device with a scraper, pivotally supported at a support arrangement and contacting the allocated roll in the pivotal operating position, an operating lever for the pivotal operation of the scraper, and a latching arrangement for fixing the scraper at least in a pivotal non-operational position not contacting the allocated compacting roll.

By the pivotal arrangement of a scraper and the allocation of an operating lever to the scraper firstly it is easily possible to pivot the scraper away from the allocated compacting roll by the interaction of an operator. In such a position pivoted off, generally a pivotal non-operating position, by providing a latching arrangement any return of the scraper in the direction of its pivotal operating position can be prevented and thus a defined distance can be ensured between the scraper and the compacting roll, for example for cleaning the compacting roll or for repair or maintenance tasks.

In order to allow ensuring a reliable introduction of force into the scraper it is suggested that the operating lever is connected to the scraper in a fastening area for a joint pivoting and shows an impingement area for introducing the pivotal operating force.

Depending on the range of elevation of the scraper device at the ground compactor in reference to a compacting roll provided, it may be advantageous for an ergonomically beneficial interaction of the operator to embody the operating lever as a pedal and/or as a handle. In a positioning in a range closer to the underground generally the embodiment as a pedal is preferred, while for a positioning at a higher elevation generally the embodiment as a handle may be advantageous, with of course the embodiment of an operating lever also being possible for both foot operation as well as manual operation.

In order to fixate the scraper in its pivotal non-operating position it may be provided that the latching arrangement comprises a latching organ, and for fixating the scraper in its pivotal non-operating position, a latching engagement with a latching organ that can engage a counter latching organ.

Here, in order to increase functionality, it may also be provided that the latching organ is adjustable between an active position and a passive position, whereby in the active position the latching engagement is engaged or can engage the counter latching organ and in the passive position is not engaged or cannot engage the counter latching organ. If the latching organ is in its active position, it can be ensured that the scraper is either held in its non-operating pivotal position or, when moved from the operating position into the non-operating position, this fastening interaction is automatically generated. When the latching organ is in its passive position, even in a motion in the direction towards the pivotal non-operating position the latching effect cannot be generated, thus the latching arrangement cannot fix the scraper in its pivotal non-operating position. This passive position of the latching organ can be particularly selected when for example the scraper shall be lifted off the compacting roll only briefly, thus pivoted out, however a fixation in the pivotal non-operating position is not required or desired, here.

In order to allow providing the latching interaction between the latching organ and the counter latching organ in a simple fashion it is suggested that the counter latching organ shows at least one latching organ stop, which can be engaged behind by the latching organ, whereby it may be advantageously provided that at least one latching organ stop is provided by a latching opening of the counter latching organ.

In a simply implemented and, with regard to its operation, easy advantageous embodiment it is suggested that the counter latching organ is provided at the support arrangement and the latching organ is pivotal [together] with the scraper. Here, for example the latching organ may be provided at the operating lever so that by the impact of the operating lever to pivot the scraper also the latching organ provided at the operating lever can be manipulated, for example brought from its passive position into its active position.

In order to allow reliably achieving the functionality provided for the scraper device during the operation of the ground compactor it is suggested that the scraper is prestressed in its pivotal operating position.

Both the function of distributing a liquid film on the roll surface of a compacting roll as well as the function of removing contaminants can be improved even further in that at least two scraper devices are allocated to the compacting roll, with preferably one scraper device cooperating with the compacting roll in the area close to the ground and one scraper device cooperating with the compacting roll in an area distanced from the ground. In particular it is here possible to arrange the two scraper devices approximately diametrically opposite each other in reference to the axis of rotation of the compacting roll so that they can fulfill their functionality of an angular distance of approximately 180°, thus evenly distributed over the perimeter of the compacting roll, to the extent possible.

Figure 2:
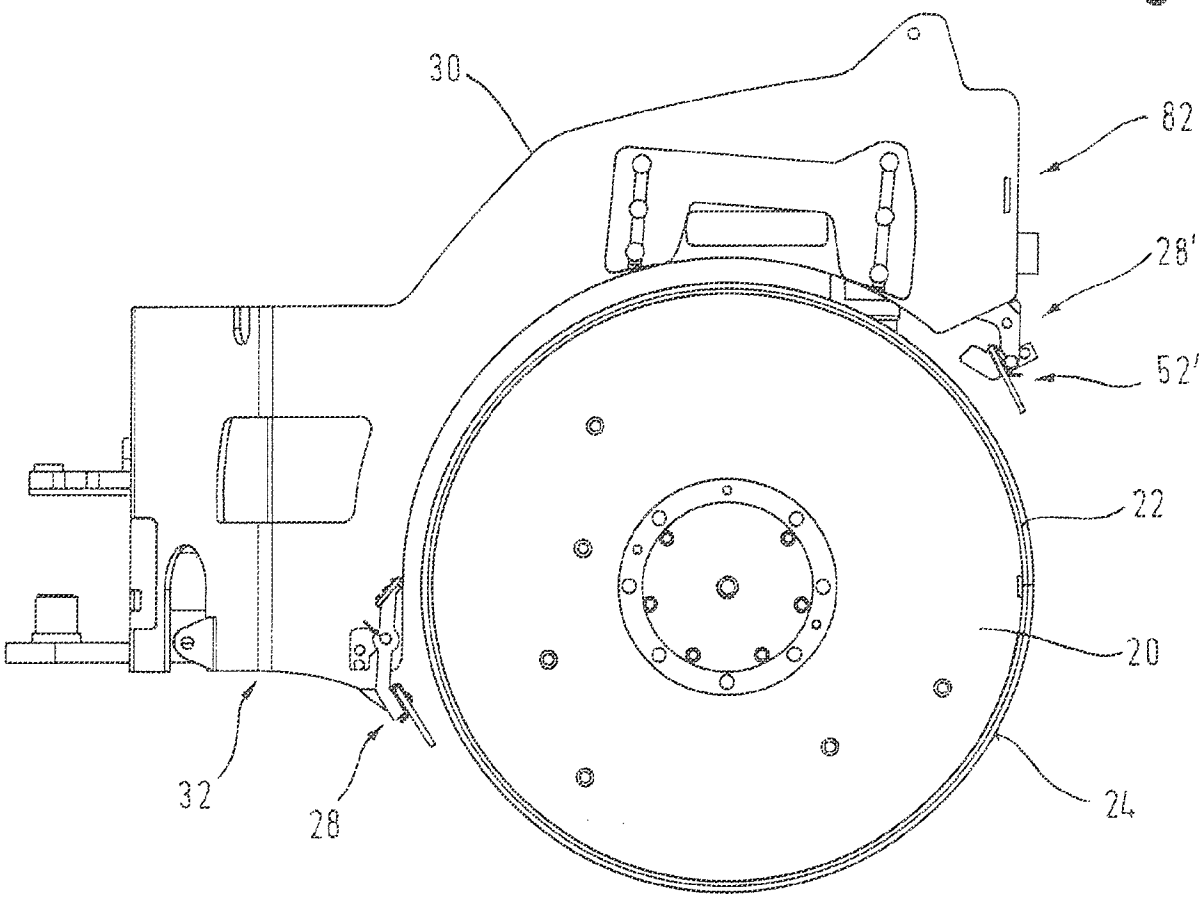
Figure 3:
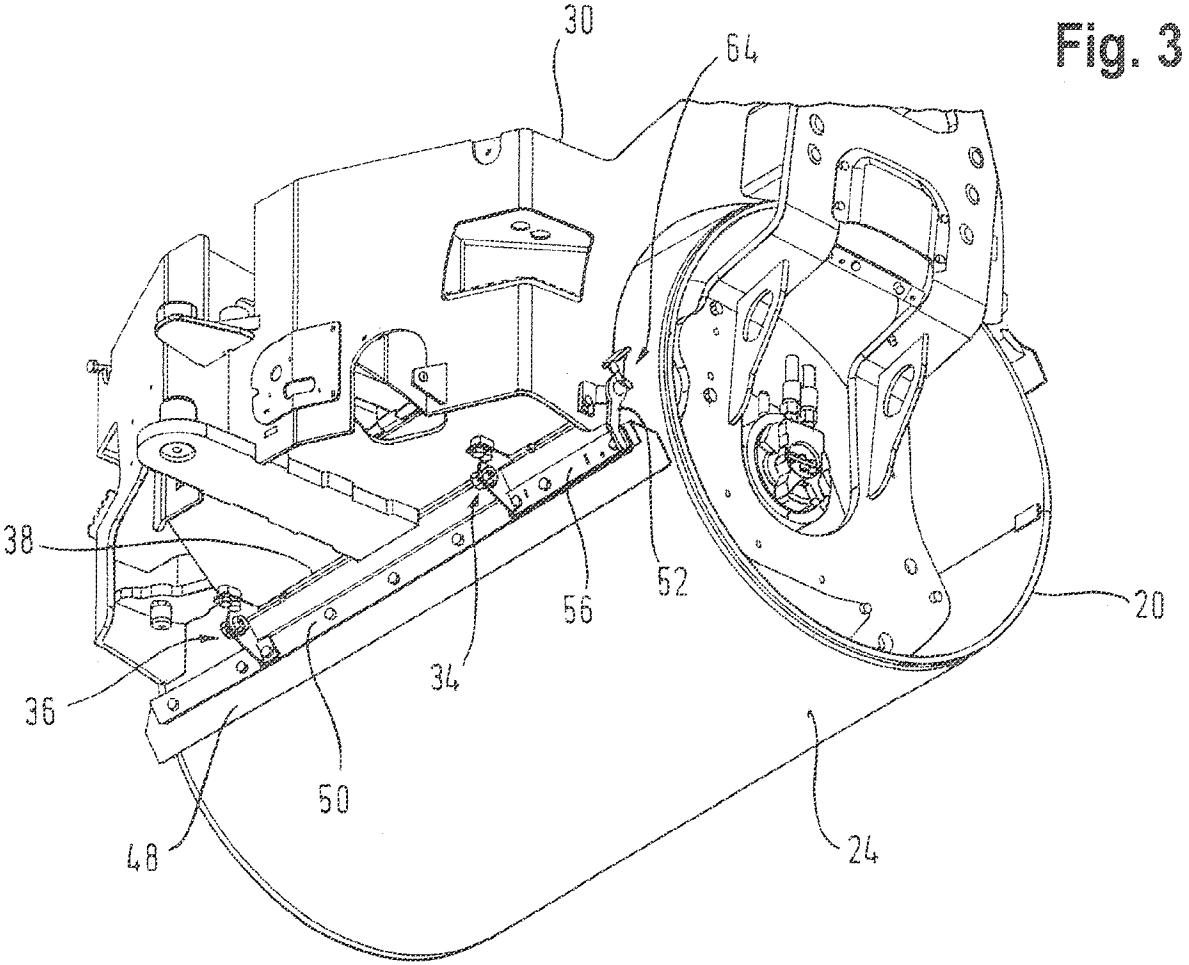
Figure 4:
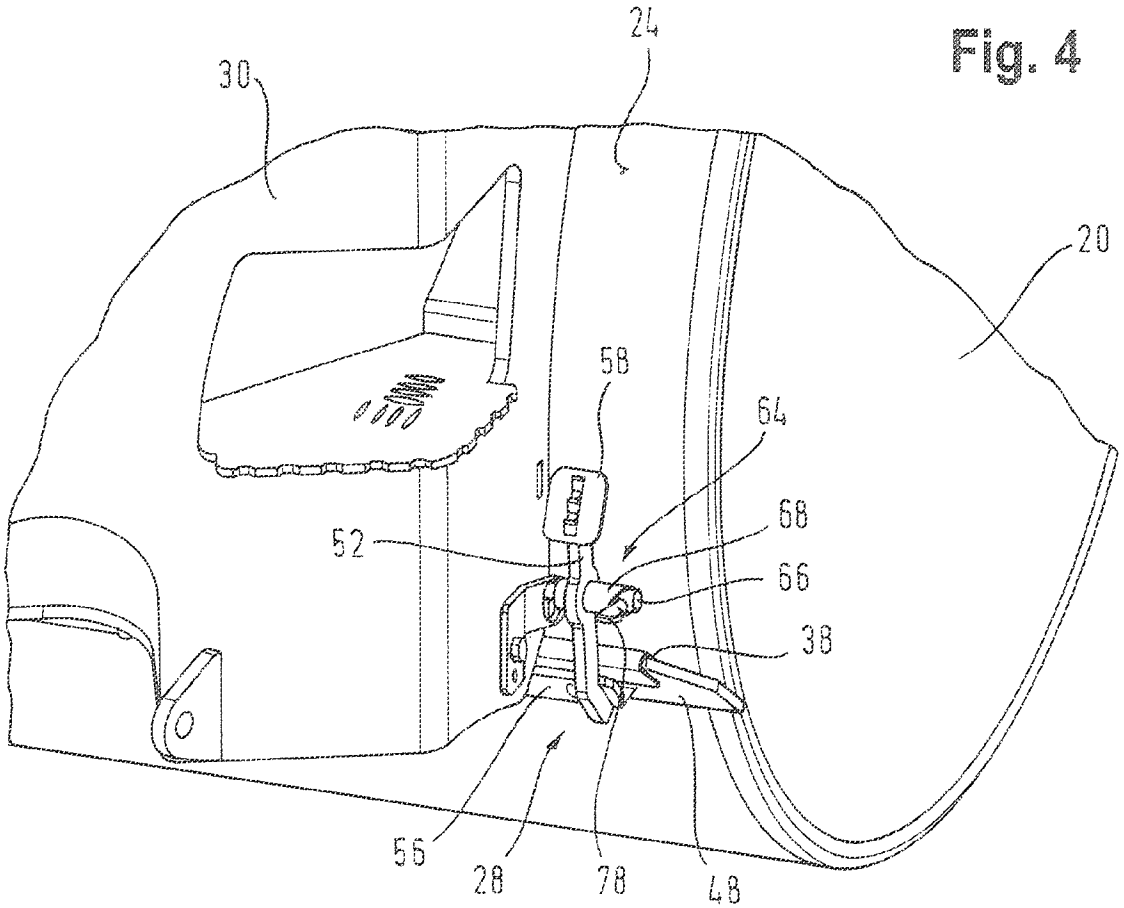
Figure 5:
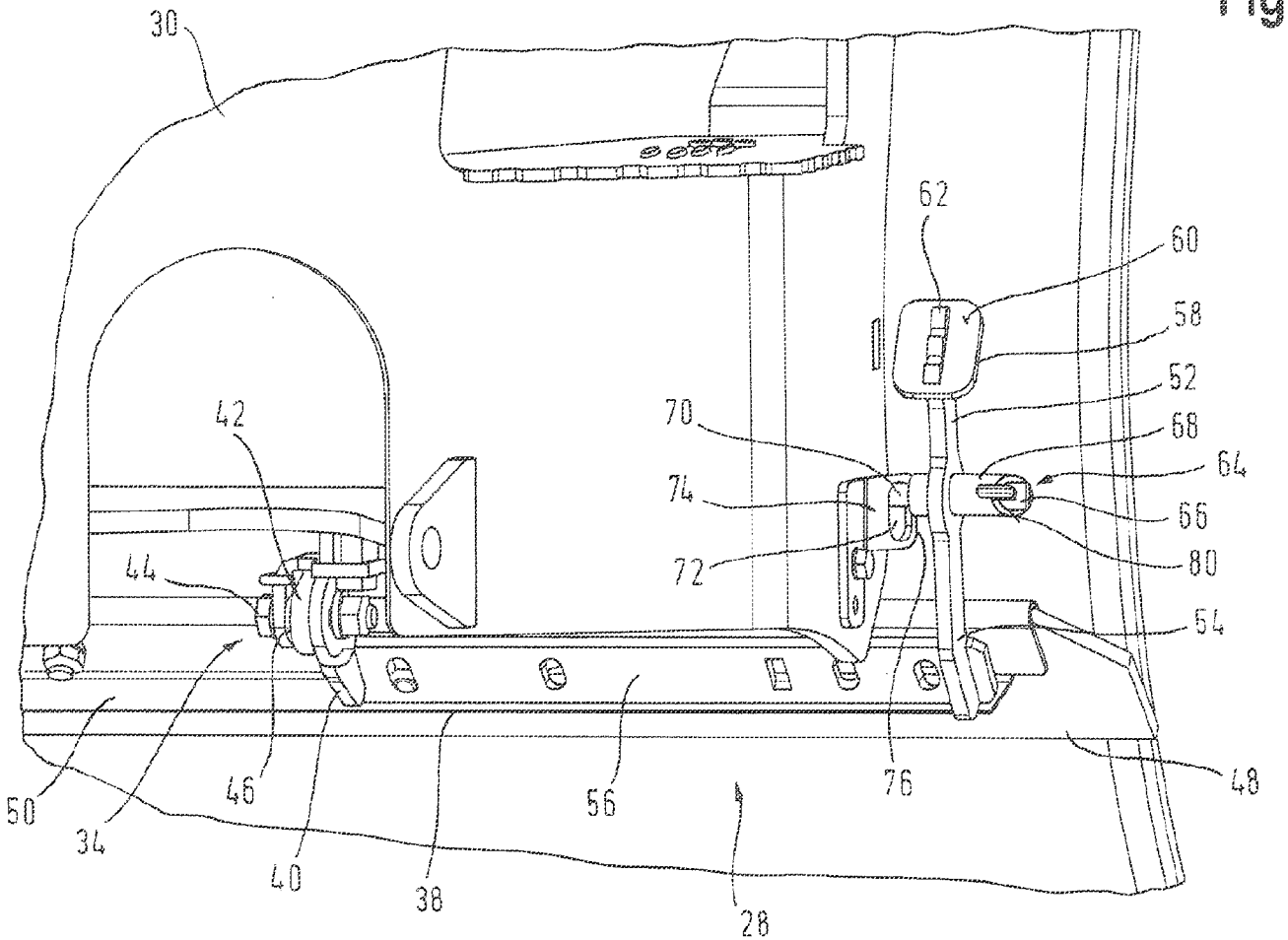
Figure 6:
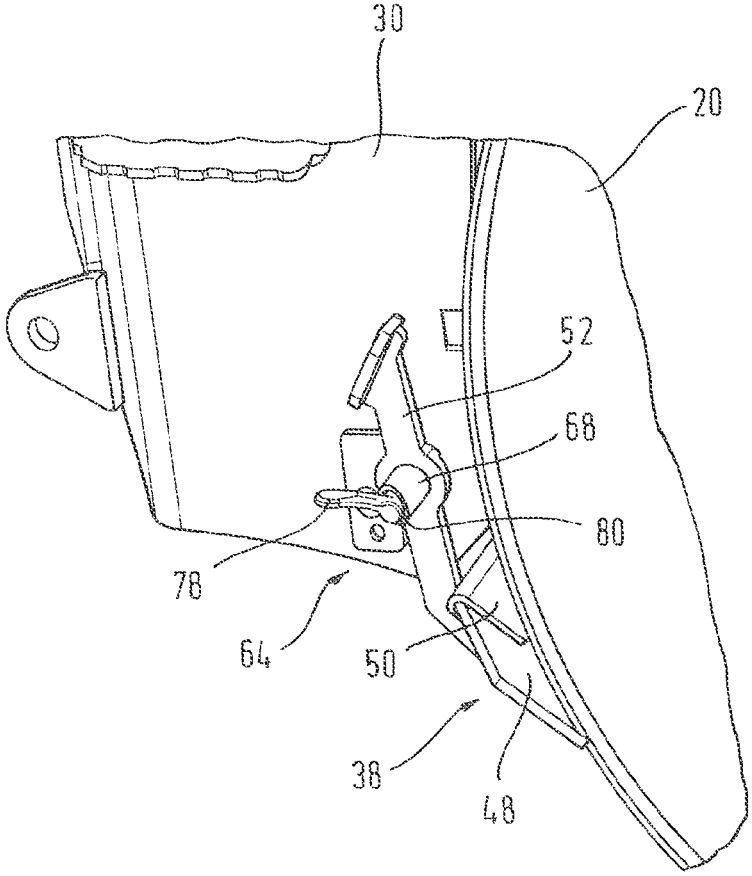

In the following the present invention is explained in detail with reference to the attached figures. It shows:

FIG. 1 a self-moving ground compactor in a side view;

FIG. 2 the front vehicle section of the ground compactor of FIG. 1 in an enlarged illustration;

FIG. 3 the front vehicle range shown in FIG. 2 in a perspective view;

FIG. 4 an enlarged detail of the front vehicle section with an operating lever of a scraper device;

FIG. 5 another enlarged detail of a front vehicle section with the scraper device and its operating lever;

FIG. 6 the operating lever of the scraper device in a different view.

FIG. 1 shows a ground compactor, in its entirety marked 10, also called compacting roll in general. The ground compactor 10 comprises a rear vehicle section 12, at which a drive engine, a driver cabin 14, and wheels 16 are provided for advancement by the drive engine, not shown. A front vehicle section 18 is pivotally connected to the rear vehicle section 12, whereby the driving direction and thus also the operating direction can be influenced by pivoting the front vehicle section 18 in reference to the rear vehicle section 12 about an essentially vertical pivotal axis.

A compacting roll 20 is provided at the front vehicle section 18. It may be allocated to a shaking or vibrating drive, not shown, in order to oscillate the compacting roll 20 during the forward motion of the ground compactor 10 and thus to influence the compacting behavior. The compacting roll 20 generally also comprises a jacket 22 as a smooth lining, with its exposed exterior surface 24 contacting the underground 26 to be compacted.

Here, it shall be pointed out that the design shown in FIG. 1 of a self-moving ground compactor 10 is only an example. It may be varied in different aspects. For example, instead of the wheels 16 another compactor roll 16 may be provided in the rear vehicle section 12 that can be driven for advancing. Two compacting rolls arranged side-by-side may also be positioned at the front and/or rear vehicle section.

A scraper device in its entirety marked 28 is allocated to the compactor roll 20, as shown in FIG. 1. This scraper device 28 may be used, for example, to distribute liquid sprayed onto the surface 24, in order to this way aggravate and/or prevent the adhesion of the underground material to be compacted. Additionally, this scraper device 28 may also be used to remove underground material from the surface 24 adhering to said surface 24 when the ground compactor 10 advances.

In the following the design of the removal device 28 is described in detail with reference to FIGS. 2 to 6.

The frame of the front vehicle section 18 with the allocated compacting roll 20 is discernible from FIGS. 2 to 6, in its entirety marked 30. In a lower section 32 of the frame 30, for example at two pivotal connection sections 34, 36, a scraper 38 of the scraper device 28 is fastened, pivotal about an axis arranged approximately horizontal. Each of these pivotal connection sections 34, 36 comprises a latch 40 at the scraper 38 and a latch 42 at the frame 30. A pivotal connection pin 44 penetrates the two latches 40, 42 and thus pivotally connects the scraper 38 to the frame 30. A leg spring 46 may be arranged surrounding the pivotal connection pin 44 and supported with its legs in reference to the latches 40, 42 and/or in reference to the scraper 38 and the frame 30 and thus prestress the scraper 38 in a pivotal operating position, in which it contacts the surface 24 of the compacting roll 20.

The scraper 38 may be embodied with a scraper blade 48, in the operating position contacting the surface 24, and a scraper bar 50 generally reinforcing the scraper 38, connected fixed to the scraper blade 48, for example by a screw connection.

At a section of the scraper 38, for example laterally projecting beyond the frame 30, an operating lever is provided in its entirety marked 52 and in the exemplary embodiment shown embodied as a pedal. In a fastening range 54 it is connected to the scraper 38. For this purpose, for example a reinforcement plate 56 may be provided at the scraper bar 50, extending between the pivotal connection range 34 and the lateral edge section of the scraper 38, and thus can ensure a distortion-proof connection of the operating lever 52 at the scraper 38. In an impingement area 58 the operating lever 52 provides a pedal surface 60, which may be embodied with a slip-resistant configuration 62, for example a rib structure or the like, in order to prevent the shoe from slipping when pressing on the impingement area.

Due to the fixed connection of the operating lever 52 to the scraper 38 any impinging of the operating lever 52 in the impingement area 58 leads to a pivoting of the operating lever 52 together with the scraper 38 about the pivotal axis of the scraper 38 defined by the pivotal connection pin 44. Here, the scraper 38 lifts off the surface 24 of the compacting roll 20 against the pre-stressing effect of the leg springs 46. In order to allow fixing the scraper 38 in this position, thus a pivotal non-operating position, the scraper device 28 comprises a latching arrangement marked 64 in its entirety. A latching organ 66 embodied as a latching pin is accepted here in a guide sheath 68, fixed at the operating lever 52, for example by welding, screwing, or the like, displaceable in the direction of the longitudinal axis of the pin and rotational about the longitudinal axis of the pin. Here, the latching organ 66 is pre-stressed towards an active position by a pre-stressing spring or the like, not shown in the figures, in which a latching end 70 of the latching organ 66 can engage a latching opening 72 in a counter latching organ 74 fixed at the frame 30. A cam-like acting deflection incline 76 is provided at the counter latching organ 74, contacted by the latching end 70 of the latching organ 66 when the scraper 38 is pivoted from the operating position to the non-operating position. By the cam effect the latching organ 66 is displaced in its longitudinal direction against the above-discussed pre-stressing effect, which in FIG. 5 represents a displacement of the latching organ 66 towards the right. This displacement continues during the further pivoting until the latching end 70 reaches the latching opening 72, for example embodied oblong. Due to the pre-stressing of the latching organ 66 it latches with its latching end 70 in the latching opening 72 and, upon continued pivoting or reverse pivoting towards the latching opening 72, contacts wall sections of the counter latching organ 74. They then prevent both a pivoting in the direction of the operating position as well as any further pivoting beyond the pivotal non-operating position defined by the latch opening 72. In order to prevent any reverse pivoting into the pivotal operating position, in general the provision of a planar or edge-like embodied stop would be sufficient, thus not necessarily a latching opening. The provision of a latching opening is advantageous, though, by its fixation in both pivotal directions.

In order to release the pivotal fixation a tensile force may be applied at an operating section and/or operating handle 78 provided at the latching organ 66, which pulls the latching organ 66 against the pre-stressing effect with its latching end 70 out of the latching opening 72. As soon as the latching end 70 no longer engages the latching opening 72 the scraper 32, due to the pre-stressing effect of the leg springs 46, will automatically pivot back into its pivotal operating position. However, when the tensile force affecting the latching organ 66 is released it moves back into its active position, in which upon renewed impingement of the operating lever 52 the latching organ 66 can be brought back into a latching interaction with the counter latching organ 74.

As explained above, the latching organ 66 is also pivotal about its longitudinal axis in the guide sheath 68 fixed at the operating lever 52. In an end section located distanced from the operating lever 52 the guide sheath 68 is provided with an ellipsoid embodied cam area 80, for example by a diagonal cutting of a tubular component, here. In a latching organ 66, pre-stressed in the active position, a rotation of the latching organ 66, perhaps caused by a rotary force acting upon the operating section 78, leads to the operating section 78 being moved along the cam surface 80 and here the latching organ 66 being displaced from its active position in the direction to its passive position. This rotational effect upon the latching organ 66 can also be used to release the latching engagement in the latching opening 72, but also to release the latching organ 66 again so that it returns to its active position following the pre-stressing effect. Here, the embodiment may be such, for example, that a rotation of the latching organ 66, based on its position displaced maximally towards the counter latching organ 74 to a displaced positioning by 90°, leads to such a displacement of the latching organ 66 that it no longer engages the latching opening 72, thus the latching interaction with the counter latching organ 74 is released, while it is still ensured that in a subsequent release of the latching organ 66 it returns to its position maximally displaced towards the counter latching organ 74. Upon a further rotation and thus also a coinciding axial displacement of the latching organ 66 the operating section 78 moving along the cam surface 80 can be moved beyond the dead center of the cam surface 88 and for example latch in a slot or recess in the cam surface provided in the guide sheath 68. In such a positioning the latching organ 66 is then in its passive position, in which it is retracted to such an extent and is also held back such that its latching interaction with the counter latching organ 74 is no longer possible. This positioning of the latching organ 66 can be selected when the production of a mandatory latching during the pivoting of the scraper 38 is not required or desired out of its pivotal operating position.

If the option to latch the latching organ 66 with the counter latching organ 74 shall be reestablished, for example by a tensile and/or rotational engagement at the operating section 78, it can be released from the recess or notch of the guide sheath 68, namely to such an extent that the dead center formed at the cam surface 80 is exceeded, and due to its pre-stressing the latching organ 66 automatically returns into the active position. Here, it may be advantageous for the cam surface 80 to be embodied symmetrical, thus based on the inactive position allowing pulling and/or rotating the latching organ 66 in any rotational direction to return into the active position.

By the structural connection of the operating lever 52 with the latching device 64 a very easy handling of the scraper device 28 is possible when latching and/or releasing so that for example the operating lever 52 is impinged by the foot and the latching organ 66 is manipulated manually or by a foot in order to release the latching engagement, for example, or to return the latching organ 66 into its active position or to move it in the direction of its passive direction, without the operator being required to bend down, whereby an ergonomically advantageous operation is yielded.

FIG. 2 shows that two such scraper devices 28 and/or 28' may be provided allocated to the very same compacting roll. The scraper device 28, explained in detail above and shown as an enlarged detail in FIGS. 3 to 6, is here provided in an area near the ground, for example at a height of maximally 40 cm above the ground at the bottom area 32 of the frame 30 so that here an operation by the foot is easily and ergonomically possible. The second scraper device 28' is arranged at an upper section 82 of the frame 30 in an approximately diametrically opposite position in reference to the rotary axis of the compacting roll 20 of the scraper device 28 such that the two scraper devices 28, 28' can fulfill their functionality distributed as best as possible over the perimeter of the compacting roll 20. Due to the fact that the scraper device 28' is positioned in an area distanced from the underground it is beneficial here to embody the operating lever allocated to the scraper device 28' as a handle, by which e.g., by a pulling engagement the scraper of this scraper device 28 can be moved out of its pivotal operating position. The structural design of the removal device 28', particularly in reference to the latching arrangement, may be embodied as described above in reference to the scraper device 28.

If two such scraper devices are provided, allocated to a compacting roll, preferably the operating levers allocated thereto are provided at the same side of the ground compactor. If the ground compactor is embodied with several compacting rolls, for example one compacting roll at the front vehicle section and one compacting roll at the rear vehicle section, and if one or more scraper devices with respective operating levers are each allocated to these compacting rolls, all of these operating levers are further preferably provided at the same side of the ground compactor so that an operator can use all operating levers very quickly, for example to perform cleaning tasks, in order to bring all scrapers into their pivotal non-operating position and to fixate them.

In the above-described embodiment of a scraper device, of course different variations may be implemented. For example, the counter latching organ may be allocated to a scraper device such that by providing several latching openings multiple pivotal non-operating positions can be set by way of latching. Furthermore, it is possible to embody the counter latching organ such that the pivotal non-operating position in which the scraper is pivoted maximally away from the allocated compacting roll is not equivalent to the maximally possible pivotal non-operating position. For example, in the pivotal non-operating position achievable by way of latching the scraper may show a distance of approximately 50 mm from the surface of the allocated compacting roll, while a maximum pivoting is possible to a distance of 60 mm, for example. Of course the scraper itself may also be designed differently and may be supported at more than only two pivotal connection areas at a support part of the ground compactor in a pivotal fashion.

The invention claimed is:

1. A self-moving ground compactor comprising:

a compacting roll;

a scraper device for the compacting roll, the scraper device including a scraper that is pivotally supported at a support device such that the scraper can be pivoted to an operating position in which the scraper contacts the compacting roll, and pivoted to a non-operating position in which the scraper does not contact the compacting roll;

an operating lever configured to pivotally operate the scraper;

a latching arrangement configured to fix the scraper in the non-operating position;

wherein the latching arrangement comprises a latching organ that is pre-stressed towards an active position and can be engaged to a counter latching organ to fix the scraper in the non-operating position;

wherein the latching organ is adjustable between an active position in which the latching organ is in a latching engagement with the counter latching organ, and a passive position in which the latching organ is not in a latching engagement with the counter latching organ; and wherein the counter latching organ includes a deflection incline that is configured to shift the latching organ towards the passive position when the scraper is pivoted from the operating position towards the non-operating position, and is configured to shift the latching organ such that the latching organ comes into latching engagement with the counter latching organ when the scraper reaches the non-operating position.

2. The ground compactor according to claim 1, wherein the operating lever is fastened to the scraper so as to allow pivoting of the scraper; and wherein the operating lever includes an impingement area for introducing a pivotal operating force to the operating lever.

3. The ground compactor according to claim 1, wherein the operating lever is embodied as a pedal and/or a handle.

4. The ground compactor according to claim 1, wherein the counter latching organ comprises a latching organ stop that can be engaged by the latching organ.

5. The ground compactor according to claim 4, wherein the latching organ stop is adjacent to a latching opening of the counter latching organ.

6. The ground compactor according to claim 1, wherein the counter latching organ is positioned on the support device; and wherein the latching organ is configured to be pivoted with the scraper.

7. The ground compactor according to claim 6, wherein the latching organ is positioned on the operating lever.

8. The ground compactor according to claim 1, wherein the scraper is pre-stressed in the operating position.

9. The ground compactor according to claim 1, wherein at least two scraper devices are allocated to one compacting roll, with one scraper device cooperating with the compacting roll in an area close to the ground, and one scraper device cooperating with the compacting roll in an area distanced from the ground.

* * * * *